United States Patent [19]

Brock

[11] 3,942,079

[45] Mar. 2, 1976

[54] CHARGING OF ELECTROPHOTOGRAPHIC SURFACES

[76] Inventor: Alan J. Brock, 26 Strangways Terrace, North Adelaide, Australia, 5006

[22] Filed: Oct. 27, 1971

[21] Appl. No.: 192,915

[30] Foreign Application Priority Data

| | | |
|---|---|---|
| Oct. 29, 1970 | Australia | 3023/70 |
| Oct. 29, 1970 | Australia | 3024/70 |
| Dec. 7, 1970 | Australia | 3423/70 |

[52] U.S. Cl. ..... 317/262 A; 250/234; 355/3 R

[51] Int. Cl.[2] ..... H01T 19/00

[58] Field of Search ..... 317/4, 262 A; 250/49.5 ZC, 250/49.5 GC, 234, 235, 236; 355/3 CH

[56] References Cited

UNITED STATES PATENTS

| | | | |
|---|---|---|---|
| 3,557,367 | 1/1971 | Roth | 317/262 A |
| 3,581,149 | 5/1971 | Tanaka et al. | 317/4 |
| 3,660,656 | 5/1972 | Frank et al. | 317/262 A |

*Primary Examiner*—R. N. Envall, Jr.

[57] ABSTRACT

The invention relates to a method of and means for conditioning photoconductive surfaces by producing a corona between a corona-producing member and a base electrode and deflecting the corona to charge the surface. The surface is charged to a low level of 10 volts or less, and the corona is deflected by a gaseous medium, or a shield of insulating material, or by a bath of oil.

7 Claims, 5 Drawing Figures

Inventor:
Alan J. Brock
By: Oldham & Oldham
Attys

CHARGING OF ELECTROPHOTOGRAPHIC SURFACES

BACKGROUND OF INVENTION

This invention relates to a method of and means for conditioning photoconductive surfaces and while it has general application to the conditioning of surfaces it is particularly useful in continuous reversal printing and similar methods where high resolution is desirable and where effects due to surface abnormalities are likely to render the image or data less acceptable.

It is well known that with photoconductive surfaces a considerable problem exists in that when the surface is charged by means of a corona and the charge is then modified by light or similar bleeding, any defects in the charging or in the surface itself will affect the reproduction of the image in that there will be a change in the latent electrostatic image at the areas where the artefact occurred.

Thus it has in the past been thought desirable in some cases to dark rest the photoconductive surface prior to use to try and obtain a uniform condition of operation and when such a surface was then charged by means of a corona device there have also been various attempts to produce a form of charging which will give a completely uniform result as otherwise the final developed image will be subject to unequal development where the image itself has been modified by any charging irregularities or the like.

SUMMARY OF INVENTION

I have now found that to achieve best results in high resolution work and particularly where continuous reversal printing or the like is required or where signals are to be recorded or where exceptionally high resolution is necessary, that an improved result is obtained where the surface is first charged at a level such that the surface is cleaned by the charging rather than that the surface has a relatively high charge impressed on it.

In explanation of this it should be mentioned that where a photoconductive surface is dark rested or otherwise held in storage for some time, there appears to be a build-up of an oxide on the surface which itself produces artefacts and if this surface is then subjected to an image there will be a degree of un-uniformity in the resultant picture or signal recording and similarly where such a surface is given a heavy charge from a corona, any defects in the corona pattern itself will again appear on the surface so that the recorded picture or signal will be modulated by these differences in the charge on the photoconductor surface.

I have found however that if the charging from a corona device is just sufficient to remove the effects of variation of the surface due to storage such as by oxidisation of the surface but not sufficient to build up a charge on the surface itself, then this neutralised surface has a high degree of uniformity which can then be light or electrically modified to produce a latent image or to produce a developed image from an applied signal which will have a very much greater uniformity.

Thus the invention can be summed up as a cancellation of charges which otherwise exist on the sheet either due to such factors as gas ion absorption on the photoconductor sheet such as in the case where zinc oxide is used or the avoidance of un-uniform charging of the surface which inevitably appears to be the case with the normal type of corona charging, the invention residing in the carrying out of charging to a degree only sufficient to act to clean electrical charges from the surface without impressing added charges of any substantial magnitude on the sheet itself.

Thus I have found that if for instance a photoconductive surface such as an insulator layer having zinc oxide embedded therein, is subjected to a negative charge by passing it beneath a negatively held electrode, and the charge is sufficiently low that generally it leaves no more than 10 volts on the photoconductor surface, then it will be found that a very much greater uniformity of a latent electrostatic image results.

To produce a voltage on a photoconductor of not greater than 10 volts of course would take a charging intensity of perhaps one-tenth of the charging intensity at present used where a photoconductor surface is subjected to a corona charging, with direct access of the corona to the surface being charged.

This low intensity charging has the effect of a relatively uniform charging of the surface without corona defects which inevitably appear to exist in normal methods.

In order to obtain a low intensity charge for this purpose it may be desirable to use a corona produced in a manner similar to present day charging but to deflect the corona by a gas stream or by a shield which blankets completely the area being charged so that no direct path exists between the corona producing medium and the surface being charged.

Thus for instance as an example of how the invention can be applied it would be possible to use a coated photoconductive film and to pass this through a cleaning device which has a charging intensity sufficient to produce a negative voltage of from 1 to 10 volts on the photoconductor surface and this photoconductor surface can then be modified either by projecting a light image on to it or by subjecting it to X-rays or other modifying rays or to subject it to recording pins or the like to which a voltage is applied so that an image will be produced on the surface which can either be a latent image or which can immediately be developed while the image is being produced or subsequently developed in the case of a latent image, and if a negative developer is used it will be realised that a reversed image will result because of the negative latent image after charging and the use of a negative developer which is then repelled from those areas where a negative charge remains but by differential action will develop the relatively positive surfaces of the photoconductor.

As stated the charging can be aided by utilizing a gas stream which impinges on the corona wire or corona source or passes through the corona zone to then carry the soft charge to the photoconductor surface with an intensity sufficient only to result in what I term an ion cleaning process which leaves the photoconductor surface with its oxide surface reduced and results in a charge on the surface of very low voltage which should not exceed 10 volts.

In the case of a shield interposed between the corona and the workpiece being charged, this should be an insulator or a semi conductor, and the corona wire or member is supported by or adjacent to the insulator or semiconductor to allow an accurate selection of position and at the same time the insulator or semi conductor can be so arranged that the charge itself is modified through the corona having to pass through or over the surface of the insulator or semi conductor.

A conductor could be used so long as it is insulated from the base electrode.

Thus for instance as an example a charging wire of substantial length if such is required, can be mounted on an insulator in such a way that the insulator provides a strong mechanical support for the charging wire and at the same time if required the insulator can also modify the charge by being disposed between the wire and the surface, although it can be used simply as a mechanical support, but by using the correct type of insulator material this can influence the actual corona discharge from the wire or similar medium to attain required results.

I have found for instance that by using materials such as cellulose acetate, polyvinyl alcohol, polyvinyl buteral, polyvinyl vinylidene, or polyvinyl polychloride that the insulator itself has a modifying effect on the charge emitted from the wire or similar medium, or it could be modified by use of a medium such as a bath of oil such as linseed oil or safflower oil or other vegetable oils, in or above which or in which the charging wire could be suspended. The wire could be mounted on a rod or the like of insulating material treated with the oil.

The materials mentioned above namely the cellulose acetate and the like are characterised by a dielectric constant between 3 and 6, this having been found useful for the control of the charging medium.

Thus for instance according to one form a rod of the stated materials could be used and this could be notched or a wire could otherwise be supported on it at a point remote from the surface being charged, so that there is no direct flow between the wire and the surface being charged, and the wire could be fixed to this rod or could be embedded in a semiconductor or the wire itself could be corrugated or otherwise shaped, so that it has a multipoint contact with the insulator or semiconductor medium or the wire could be in a position where charging from it can take place directly to the surface without the insulator medium being interposed, but preferably is still attached to the insulator medium, so as to maintain the required rigidity and location.

In such a case also the semiconductor can be used to at least partly or wholly embed the wire in it and this could form the attachment means to an insulating rod which could serve as the support, and it will be obvious that a rod of this nature could be of varying cross-sections to ensure that either it serves as a shield between the surface being charged and the wire or the like or it can have edge effects by being say of triangular shape which will cause modifications of the corona discharge by the shape of the insulator or the semiconductor, the objects of the invention being ahcieved by controlling the corona discharge by providing first a support or shield for the electrode from which the corona is produced and secondly by embedding or partly embedding it in a semiconductor or the like which can in effect control what might be termed secondary corona emission due to the existence of conducting particles or medium in for instance a body of insulator medium so that the corona discharge instead of issuing directly from the electrode will give rise to discharge from what may be termed transfer means adjacent to or surrounding the electrode.

A further advantage can be obtained if the insulating medium is of such a nature that a certain amount of leakage of the corona charge can take place through the insulating member, and here again the materials with a dielectric constant between 3 and 6 are suitable, so that in effect there is some charge transmitted through the insulating medium as well as allowing the charge to spill over the edge of the medium, the insulating material however being capable of filtering the charge to prevent unwanted components, such as gas ions generated at the corona source, from reaching the surface being charged. The corona can be frequency modulated so that by use of a higher frequency the corona can be caused to move on the insulator shield by surface effects, and in this way penetration through the shield can be regulated.

In the latter case the resistivity of the roller or rod should be so selected that a high frequency, but low voltage charge which is then desirable will appear on the surface of the rod or shield, and for this purpose, the rod or shield can be built up of an insulating medium which has embedded in it conductive particulate materials or the like to make the roller a semiconductor.

From the foregoing it will be realised that the charge from the wire or other electrode instead of being simply allowed to take place into air adjacent to the surface to be charged, whether directed by a shield or not, is modified by an insulator or a semiconductor positioned in such a way in relation to the surface being charged that the corona is influenced by the presence of this medium and thus by either shaping the corona producing means or the insulator or semiconductor means, the emission of the corona can be closely controlled to achieve any desired charging effects.

Thus secondary effects can be produced through the association with the corona of insulator or semiconductor mediums which can then control the charging of the surface of the photoconductive medium while by superimposing a modulating frequency surface effects can be further controlled.

When the insulating member is interposed directly between the corona producing member and the surface to be charged and is an electrically insulating member, a charge does not build up on it in the same way as would be the case if the member were of conductive material, and research has shown that the spill over which takes place at the edges of the insulating or semiconductive sheet is in the nature of a soft charge from which ions have been removed and which thus results in a charge which does not produce artifacts on the surface.

As a matter of interest it can be mentioned that when a concave insulating disc of glass or the like was interposed between a corona point and a surface, an annular charged area resulted around the edge of the disc with an uncharged area immediately within it but at the centre of the disc at the point of the corona discharge there were various patterns produced on the photoconductor which showed artifacts of very regular patterns, increasing in dimension outwardly from the immediate centre which was axially aligned with the point but terminating long before the area is reached where the soft charge spilt over the edge of the insulating member.

From an examination of the effects where this central charge took place it is obvious that charged particles either penetrated the insulating medium and marked the photoconductor surface with what could be termed nuclei having branches extending from them in the nature of Lichtenberg figures but this effect was only apparent when the point was fairly close to the centre of the dish of insulating material and the dish in turn was quite close to the surface of the photoconductive medium.

It was shown that where the point and the dish were removed to some distance from the surface, say about 3 inches at a charging voltage of 15,000 volts, complete shielding of the central area resulted as there appeared to be no penetration due to the charged particles.

From this it follows that if for instance a wire is placed across an area which is to be charged and where relative motion exists between the wire and the surface to be charged, if an insulating member is placed between the wire and the photoconductive surface, then this can remove the direct charging pattern which would otherwise produce artifacts on the surface but a charge will nevertheless spill over the edges of the insulation and some will pass through the insulator or semiconductor but in a filtered condition, to reach the surface being charged and the charge which spills over the edges and which may also pass through will be found to be of a very soft characteristic which will give extremely uniform charging or neutralisation or cleaning of the surface at this locality.

As the distance and physical properties of the shield can be widely varied, and as the voltage used can be increased or decreased, tests should be applied to achieve optimum conditions. This can readily be done by moving the corona-producing member and shield to a distance where the corona leaves a uniform soft charge without any mottling in the area beneath the shield when the charge left is developed by photoelectric methods. Naturally when the correct distance has been found, the medium to be charged can be passed through the area and the spill-over or filtered penetration of the corona of the shield will give the required low-level uniform charging.

This can be readily carried out using a corona-producing wire and shield extending transversely across the area through which the medium to be charged is traversing.

BRIEF DESCRIPTION OF DRAWINGS

Reference will now be made to the invention in relation to the drawings which are by way of illustration only and not to be taken as in any way limiting the invention.

In the drawings.

PREFERRED EMBODIMENTS

Figure 1:
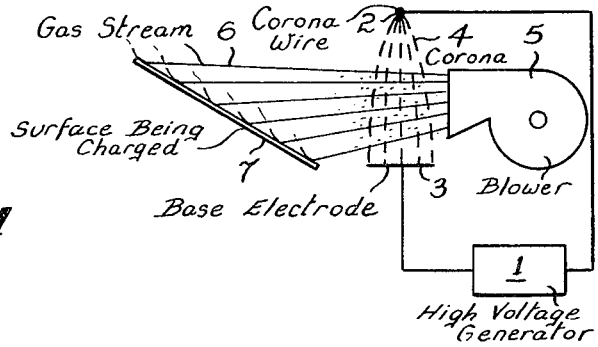
FIG. 1 is a schematic side elevation showing how if a corona is developed between an electrode wire or point and a base electrode and a stream of gas is blown through this corona it can carry charges from a corona to a surface to be charged.

Referring first to FIG. 1, which merely teaches that a corona can be physically disrupted into wanted and unwanted components, it will be noted that a high voltage generator 1 is connected to a corona wire 2 and a base electrode 3 to produce a corona 4 between the wire and the base electrode.

A blower 5 directs a stream of air or gas 6 to the surface 7 being charged, the stream of air or gas carrying charging electrons with it or being modified by the electrons so that the surface of the member 7 is charged, but because there is no direct impingement of the corona as such on this surface, charging is in the nature of a low voltage charge within the spirit of this invention, the ions from the discharge passing to the base electrode and not being transmitted to the surface of the member 7 which may be a photoconductor or insulator.

Figure 2:
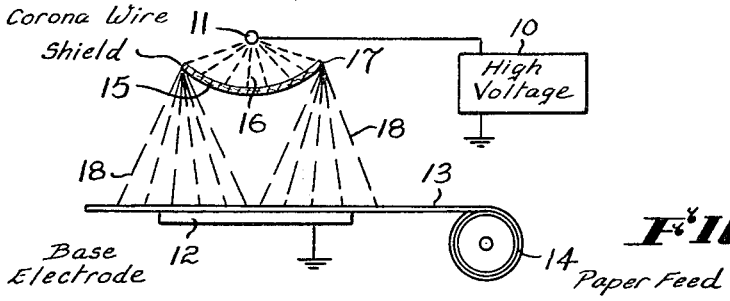
FIG. 2 is a side elevation of one form of the invention in which a corona wire is protected by an insulating shield which causes the corona to flow over the edges and directly charge a surface beneath.

In the case of FIG. 2, a high voltage generator 10 is connected between earth and a corona wire 11 while a base electrode 12 is again earthed and is adapted to take a photoconductive paper feed or an insulator membrane 13 from a roll 14 which is charged while it is at rest or passes over the base electrode 12.

Interposed between the corona wire 11 and the base electrode 12 is a shield 15 of insulating material or of a semiconductor which intercepts the direct components of a corona 16 but allows flow over the edges 17 of the shield in the direction of the base electrode 12, because of the potential gradient, so that the areas 18 are again in the nature of a soft charge.

Figure 3:
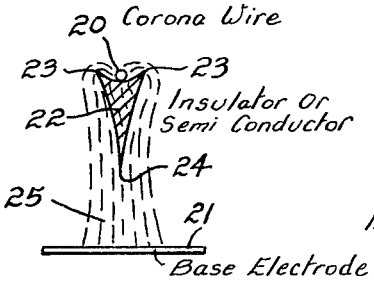
FIG. 3 shows a knife type of support for a corona wire which again shields a corona against direct inition to base electrode but guides the corona along its surface.

In the embodiment shown in FIG. 3 the corona wire 20 is shielded from the base 21 by a knife-shaped shield 22 which has upwardly projecting points 23 and a downwardly projecting knife edge 24, this being constructed of insulating material or a semiconductor and having the effect of causing the corona to spill over to the base electrode as indicated by 25, this again resulting in a soft charging of the surface but with some amount of directional effect imparted by the member 22.

The insulator or semiconductor in this case can have a secondary corona produced at the point 24 but because the primary corona wire 20 is substantially shielded by the insulator or semiconductor member 22, the resultant charge which reaches the base electrode again has the effect of a soft charge.

Figure 4:
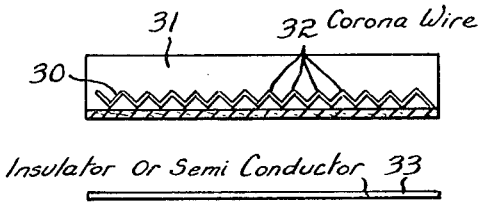
FIG. 4 shows how a corona wire can be held in a shield similar to FIG. 2 but the corona wire is corrugated to be supported by the shield itself.

In FIG. 4 a corona wire 30 is supported in an insulating or semiconductive shield 31, which again can have a form similar to that shown in FIG. 2, the purpose of the corrugations of the corona wire being to provide a series of nodes 32 which enhance distribution of the corona within the shield.

In FIG. 4 the base electrode is designated 33, and the medium to be charged will of course pass between the underside of the shield 31 and the upper side of the base 33.

As stated earlier in the specification, the corona can be frequency modulated so that by use of a higher frequency the corona can be caused to move on the insulator shield by surface effects but it will be realised that in any event a corona, even if generated from a direct current source, has a frequency component which is made use of in this invention to achieve the surface effects referred to.

Figure 5:
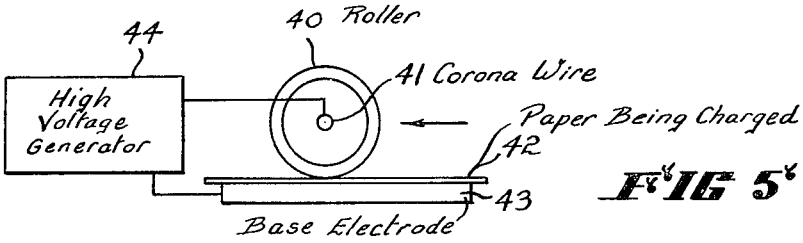
FIG. 5 shows a variation wherein the shield is in the form of a roller with the corona wire inside the roller.

In FIG. 5 is shown a variation in which a roller 40 of insulating or semiconductive material has within it a corona wire 41 or a series of discharge points if this is preferred, the roller passing over the surface 42 which is to be charged which rests on a base electrode 43, the high voltage generator 44 being connected to the corona member 41 and the base electrode 43 respectively.

I claim:

1. The method of charging surfaces which comprises producing a corona between a corona-producing member and a base electrode, causing corona components to be deflected by an isolated interposed insulator or semi-conductive member to the area where the charge is to be applied, and positioning a member which is to be charged directly in the area of the deflected corona whereby the corona passes at least over the insulator or semi-conductor surface, the shield being formed of an insulator or semi-conductor taken from the group cellulose acetate, polyvinyl alcohol, polyvinyl buteral, polyvinyl vinylidene, or polyvinyl polychloride.

2. The method of charging surfaces which comprises producing a corona between a corona-producing member and a base electrode, causing corona components to be deflected by an interposed insulator or semi-conductive member to the area where the charge is to be applied, and positioning a member which is to be charged directly in the area of the deflected corona, whereby the corona passes at least over the insulator or semi-conductor surface, an insulating or semi-conducting shield surrounding said corona-producing member, and extending the corona through the material of said member.

3. The method of claim 2 wherein the insulating or semiconducting shield is a hollow roller with the corona-producing member within it, and passing the roller over the surface to be charged while electrically energising said corona-producing member.

4. The method of charging surfaces which comprises producing a corona between a corona-producing member and a base electrode, causing corona components to be deflected by an isolated interposed insulator or semi-conductive member to the area where the charge is to be applied, and positioning a member which is to be charged directly in the area of the deflected corona, whereby the corona passes at least over the insulator or semi-conductor surface, the corona-producing member being a wire extending transversely over the area where a member to be charged is traversed, maintaining a shield formed of an insulator or semi-conductor member beneath the said corona-producing wire, and moving the member which is to be charged through the said area.

5. The method of charging surfaces which comprises producing a corona between a corona-producing member and a base electrode, causing corona components to be deflected by an interposed insulator or semi-conductive member to the area where the charge is to be applied, and positioning a member which is to be charged directly in the area of the deflected corona whereby the corona passes at least over the insulator or semi-conductor surface, the corona-producing member being a wire extending longitudinally in a hollow in a co-extensive blade of insulating or semi-conductive material, shielding the wire from the area to be charged by means of the said blade, and applying a high frequency component of the charging current being applied to the wire whereby surface effects on the blade are introduced.

6. The method of charging surfaces which comprises producing a corona between a corona-producing member and a base electrode, causing corona components to be deflected by an interposed insulator or semi-conductive member to the area where the charge is to be applied, and positioning a member which is to be charged directly in the area of the deflected corona, whereby the corona passes at least over the insulator or semi-conductor surface, an extending insulating or semi-conducting shield being interposed between the corona-producing member and the said base electrode, said shield having a recess facing away from the said base electrode, positioning the said corona-producing member in said recess to extend along the same, said corona-producing member having nodes along its extension to form corona generating points along the said member.

7. The method of claim 6 wherein the corona-producing member has a corona producing voltage applied to it which has a high frequency component.

* * * * *